US005927105A

United States Patent [19]

Cho

[11] Patent Number: 5,927,105

[45] Date of Patent: Jul. 27, 1999

[54] PULSATOR ASSEMBLY OF A WASHING MACHINE

[75] Inventor: In-Su Cho, Kwangju, Rep. of Korea

[73] Assignee: Daewoo Electronics Co., Ltd, Seoul, Rep. of Korea

[21] Appl. No.: 09/062,658

[22] Filed: Apr. 20, 1998

[30] Foreign Application Priority Data

May 29, 1997 [KR] Rep. of Korea ..... 97-21788

[51] Int. Cl.[6] ..... D06F 17/10

[52] U.S. Cl. ..... 68/23.6; 68/134

[58] Field of Search ..... 68/23.6, 23.7, 68/131, 133, 134

[56] References Cited

U.S. PATENT DOCUMENTS

| | | | |
|---|---|---|---|
| 5,595,072 | 1/1997 | Bai et al. | 68/122 |
| 5,680,780 | 10/1997 | Kim et al. | 68/134 |
| 5,722,265 | 3/1998 | Cho | 68/134 X |
| 5,727,413 | 3/1998 | Na | 68/134 X |
| 5,839,299 | 11/1998 | Lee | 68/134 |
| 5,839,300 | 11/1998 | Yoon et al. | 68/134 |

*Primary Examiner*—Philip R. Coe
*Attorney, Agent, or Firm*—Pillsbury Madison & Sutro LLP

[57] ABSTRACT

A pulsator assembly of washing machine having a plurality of auxiliary pulsators. The washing machine has an outer tub, a spin tub rotatably accommodated within the outer tub, a main pulsator rotatably disposed at an inner lower portion of the spin tub, a plurality of auxiliary pulsators disposed at an upper surface of the main pulsator, the plurality of auxiliary pulsators being symmetrically arranged opposite to each other about a rotating shaft of the main pulsator, the plurality of auxiliary pulsators being moved in the upward and downward directions while the main pulsator is being rotated, thereby generating a turbulent liquid flow in the spin tub, and a plurality of elastic members respectively disposed between the plurality of auxiliary pulsators and the main pulsator for elastically biasing the plurality of auxiliary pulsators toward the main pulsator. Since the pulsator assembly of the washing machine agitates an upward liquid flow by a pair of auxiliary pulsators while a washing cycle is being executed, a turbulent liquid flow is generated in the spin tub, thereby preventing articles from tangling with each other. Furthermore, the turbulent liquid flow collides with the articles, thereby improving the washing effect.

12 Claims, 6 Drawing Sheets

PULSATOR ASSEMBLY OF A WASHING MACHINE

BACKGROUND OF THE INVENTION

1. Field of the Invention

The present invention relates to a washing machine, and more particularly to a pulsator assembly of a washing machine.

2. Description of the Prior Art

Generally, a washing machine is an apparatus for separating dirt from articles to be washed such as clothing by sequentially carrying out various cycles in the order of washing, rinsing, and drying.

While the above cycles are being executed, dirt contained in the articles separates from the articles by means of friction between a liquid flow and the articles or by means of detergents.

In order to increase the washing effect, the conventional washing machine has a spraying nozzle unit for spraying a washing liquid to the articles in the spin tub provided at a lower portion of the spin tub.

One of the conventional washing machines is disclosed in a U.S. Pat. No. 5,595,072 (issued to Sang-Chul Bai).

As illustrated in FIG. 1, a washing machine 100 has an outer tub 110, a spin tub 120 rotatably accommodated at an inner portion of the outer tub 110, a pulsator 160 rotatably disposed at an inner lower portion of the spin tub 120 and formed at an upper surface thereof with an agitating blade 162 which is radially formed thereon for agitating articles, a spin shaft 130 connected to a lower portion of the spin tub 120 so as to rotate the spin tub 120, a washing shaft 140 connected to the pulsator 160 for rotating the pulsator 160 in the forward and backward directions, and a pumping member 150 integrally connected to the washing shaft 140 for pumping a washing liquid.

The spin shaft 130 is provided at an upper periphery thereof with a first bearing member 132 so as to be freely rotated. The first bearing member 132 is provided at a periphery portion thereof with a first sealing member 134 for preventing the washing liquid stored in the outer tub 110 from leaking to an exterior of the outer tub 110.

The washing shaft 140 is rotatably disposed inside the spin shaft 130, and is provided with a second bearing member 144 in order to be rotated relative to the washing shaft 140. The bearing member 132 is provided at an upper portion thereof with a second sealing member 142 for preventing the water liquid from leaking to a power transmission apparatus (not shown) through a chasm between the washing shaft 140 and the spin shaft 130.

The washing shaft 140 extends from the second sealing member 142 in order to be connected to a lower portion of a connector 152. The connector 152 is connected to a pumping member 150 having a plurality of blades for pumping the washing liquid stored in the outer tub 110 to an inside of the spin tub 120.

The connector 152 is coupled at its upper end to the pulsator 152 by means of a serration. The pulsator 160 includes an agitating blade 162 for agitating the articles in the spin tub 120, an ejection unit 169 for spraying the washing liquid flow discharged from the pumping member 150 toward a central portion in the spin tub 120, and a boss unit 154 connected by the serration to an upper periphery of the connector 152. The ejection unit 169 is formed with a recess 167 in which a filtering member 164 is so mounted that the articles cannot flow into the pumping member 150.

The recess 167 is formed at a bottom portion thereof with an exhaust nozzle 168.

Furthermore, the boss unit 154 is formed therein with a central hole 156, through which a fixing member 172 is screwed to an inner portion of the washing shaft 140 so that the washing shaft 140, the connector 152, the pumping member 150 and the pulsator 160 are integrally assembled and are rotated along with the washing shaft 140.

Meanwhile, a flange formed at an upper portion of the spin shaft 130 is fixedly connected at an upper portion thereof with a lower portion of the spin tub 120 by a fixing member (not shown).

The spin tub 120 is provided at a lower portion thereof with a housing 170 fixed by a plurality of fixing members 172 to an inner periphery of the spin tub 120 so that the washing liquid is guided to the pumping member 150.

The housing 170 is formed at a lower portion thereof with an opening hole 174 so that the pumping member 150 integrally connected to the washing shaft 140 passes through the opening hole 174 and is placed at an upper space of the opening hole 174.

The upper space of the opening hole 174 is covered by a cover member 175 fixed to the housing 170 by fastening screws 176 so that the washing liquid absorbed through a suction inlet 180 is ejected to the upper space through the pumping member 150, and is guided to the exhaust nozzle 168, and finally is ejected to a bottom surface 166 of the pulsator 160.

In a state when the articles and detergent are disposed in the spin tub 120, and while the washing or rinsing process is being carry out, the washing shaft 140 is oscillated so that the pumping member 150 and the pulsator 160 fixed to the washing shaft 140 by the connector 152 are oscillated.

At this time, the washing liquid stored in the outer tub 110 is absorbed into the pumping member 150 through the suction inlet 180 due to a rotation of the pumping member 150. The washing liquid sucked into the pumping member 150 is rapidly discharged outwardly through the plurality of blades 155 of the pumping member 150, and is guided through an open space formed by walls of the housing 170 and the cover member 175 and is upwardly ejected from a central portion of the spin tub 120 through the exhaust nozzle 168. Accordingly, a liquid flow is formed in the spin tub 120 as illustrated by an arrow 182 in FIG. 1.

However, in the conventional washing machine, since the structure of the pulsator is complicated, the manufacturing process thereof is complicated, and the manufacturing cost thereof is increased.

SUMMARY OF THE INVENTION

Accordingly, the present invention is contrived to solve the foregoing problems, and an object of the present invention is to provide a pulsator assembly for a washing machine capable of effectively forming a turbulent liquid flow in a spin tub, thereby preventing the articles to be washed from tangling with each other and increasing the washing effect.

In order to achieve the above object, the present invention provides a washing machine comprising:

an outer tub;

a spin tub rotatably accommodated within the outer tub;

a main pulsator rotatably disposed at an inner lower portion of the spin tub;

a plurality of auxiliary pulsators disposed at an upper surface of the main pulsator, the plurality of auxiliary pulsator being symmetrically arranged opposite to each other about a rotating shaft of the main pulsator, the plurality of auxiliary pulsator being moved in upward and downward directions while the main pulsator is being rotated, thereby generating a turbulent liquid flow in the spin tub; and a plurality of elastic members respectively disposed between the plurality of auxiliary pulsator and the main pulsator for elastically biasing the plurality of auxiliary pulsator toward the main pulsator.

According to the preferred embodiment of the present invention, the washing machine includes two auxiliary pulsators which are symmetrically disposed with respect to each other. The spin tub is formed at the inner lower portion thereof with a circularshaped opening in which the main pulsator is mounted, and the circular-shaped opening is formed at an edge portion thereof with a prominence and depression portion which is upwardly formed from the edge portion, and the plurality of auxiliary pulsators make slide contact with an upper surface of the prominence and depression portion so that the plurality of auxiliary pulsator are upwardly and downwardly moved while the main pulsator is being rotated.

The main pulsator has a pulsator body and a plurality of recesses formed at an upper surface of the pulsator body, and the plurality of recesses have a shape corresponding to a shape of the plurality of auxiliary pulsators. Each auxiliary pulsator is respectively received in each of the recesses. Each of auxiliary pulsators respectively has a plate received in each of the recesses, auxiliary agitating blades upwardly protruded from an upper surface of the plate, a hanger downwardly protruded from a lower surface of the plate, and a roller rotatably mounted at a lower end portion of the hanger. The recesses and the plate have a trapezoid shape.

Each of the plates has a first end portion formed with a through hole, and each of the recesses is formed at an inner wall thereof with a pair of receiving holes, and a hinge pin is screwed into the pair of receiving holes through the through hole so that each of the plurality of auxiliary pulsators is hingedly connected to the main pulsator.

Each of the hangers is provided to a lower surface of a second end portion disposed opposite to the first end portion of the plate, and the second end portion extends beyond a circumference of the main pulsator so that the roller of the hanger makes slide contact with the upper surface of the prominence and depression portion.

Each of the hangers is formed at a lower portion thereof with an elongated slot, and the roller is rotatably mounted within the elongated slot. Each roller is respectively and rotatably fixed within the elongated slot by a hinge pin. Each of the plurality of elastic members includes a compression spring. An upper locker is respectively formed at a predetermined position of the lower portion of each auxiliary pulsator, and a lower locker is respectably formed at a predetermined position of a bottom surface of each recess, an upper end portion and a lower portion of the plurality of elastic members are fixedly coupled to the upper and lower lockers, respectively.

As described above, a pulsator assembly for a washing machine according to the present invention has an advantage of the structure being simple, and the washing liquid current is effectively formed, thereby increasing the washing effect.

BRIEF DESCRIPTION OF THE DRAWINGS

Other objects, characteristics and advantages of the present invention will become more apparent by describing in detail a preferred embodiment thereof with reference to the attached drawings in which.

DETAILED DESCRIPTION OF THE INVENTION

Hereinafter, a preferred embodiment of the present invention will be explained in more detail with reference to the accompanying drawings.

Figure 1:
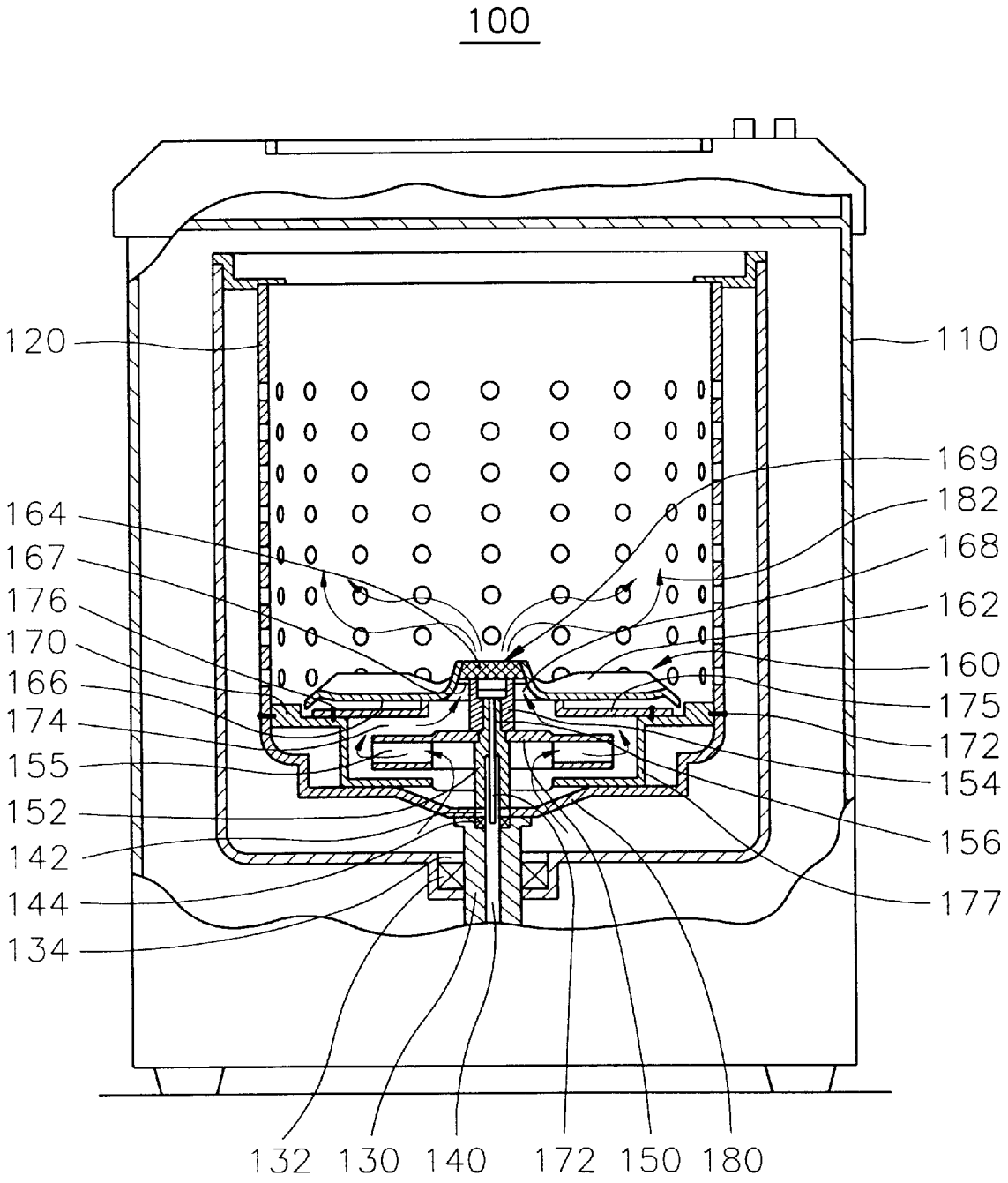
FIG. 1 (PRIOR ART)
FIG. 1 is a partial cross-sectional view showing the conventional washing machine.
Figure 2:
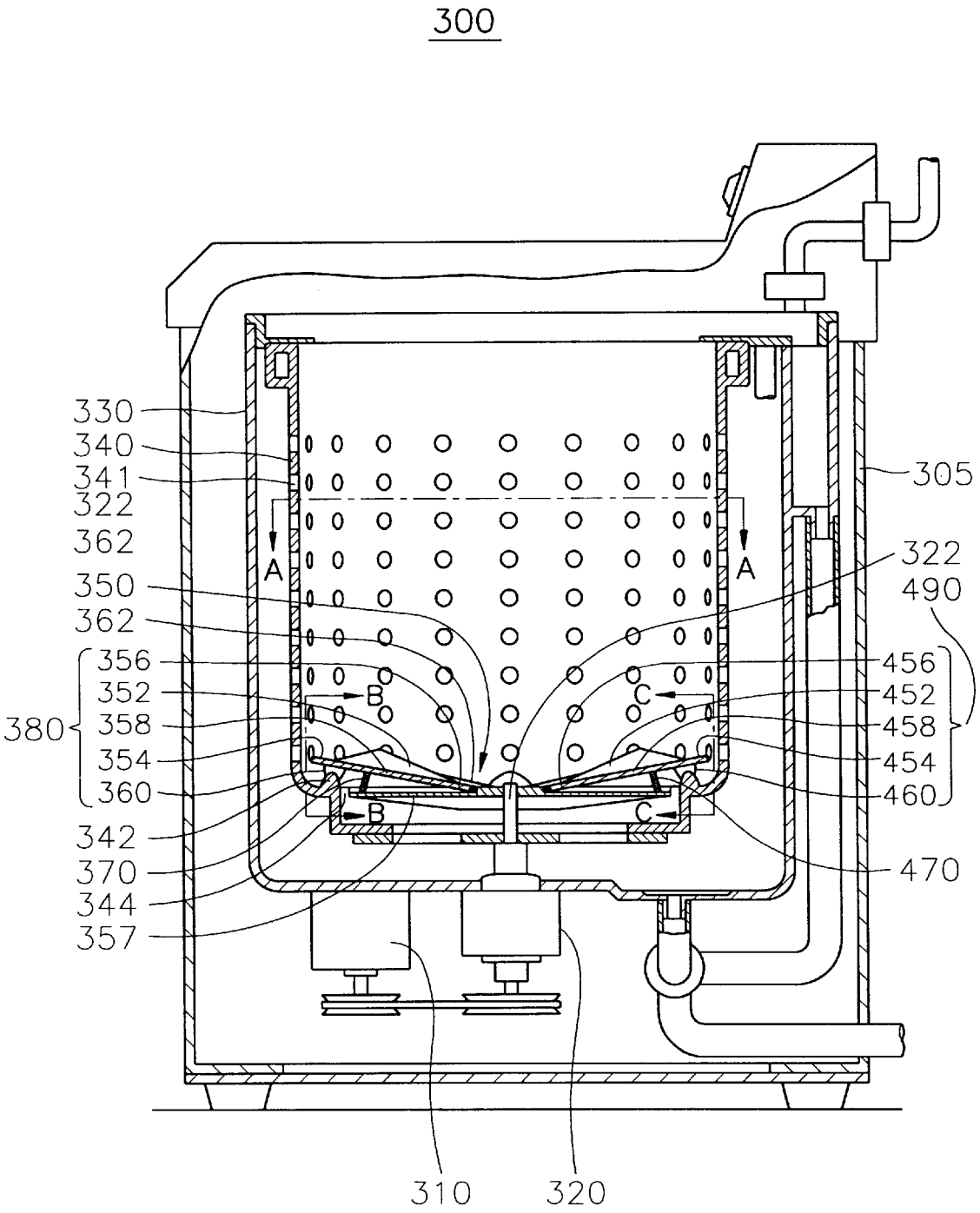
FIG. 2 is a partial cross-sectional view showing a washing machine according to one embodiment of the present invention.
Figure 3:
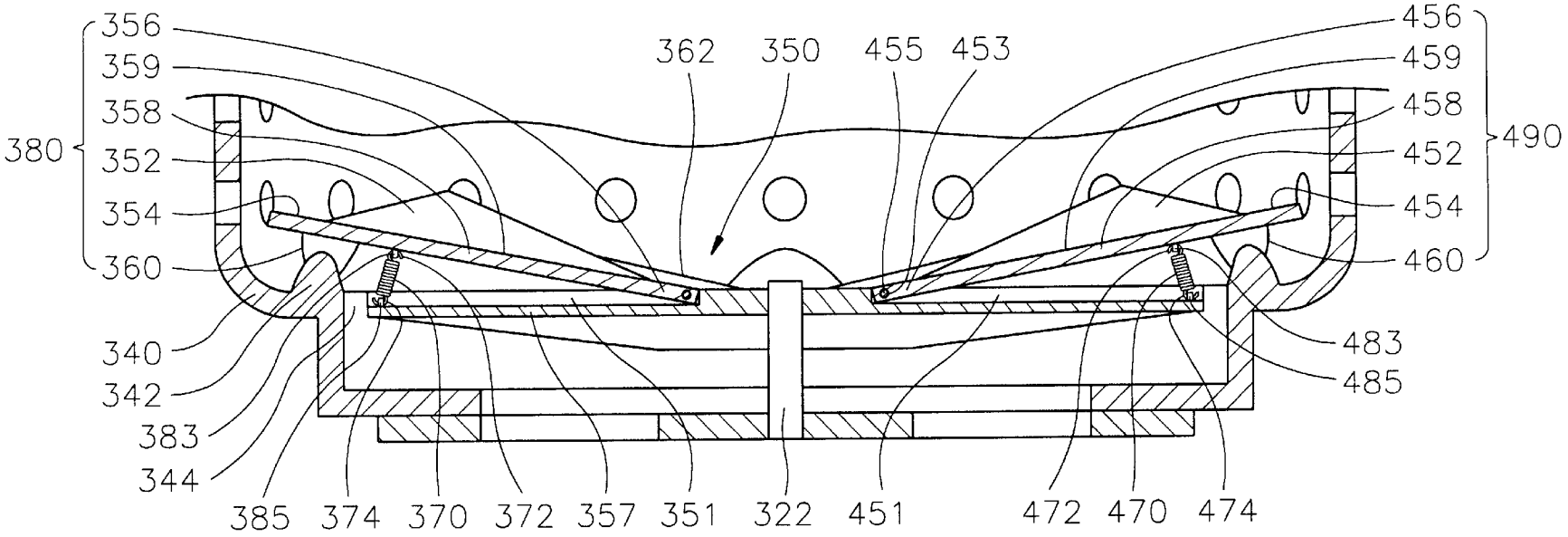
FIG. 3 is an enlarged cross-sectional view showing a pulsator assembly for the washing machine according to the present invention.

FIG. 2 is a partially cross-sectional view showing a washing machine 300 according to one embodiment of the present invention, and FIG. 3 is an enlarged cross-sectional view showing a pulsator assembly 350 for the washing machine 300 according to the present invention. Generally, the washing machine 300 has a housing 305 forming an outer wall of the washing machine 300, an outer tub 330 accommodated within the housing 305 for storing a supplied water, a spin tub 340 rotatably disposed within the outer tub 330 and formed at a side wall thereof with a discharging hole 342, a motor assembly 310 placed at a lower portion of the outer tub 330 for generating a driving force for driving the washing machine 300, a gear assembly 320 for transmitting the driving force of the motor assembly 310 to the spin tub 340, and a pulsator assembly 350 connected to an upper portion of a driving shaft 322 of the gear assembly 320 and rotatably disposed at a lower surface in the spin tub 340.

The spin tub 340 is formed at an inner lower portion thereof with a circular-shaped opening 344 in which the pulsator assembly 350 is mounted. The circular-shaped opening 344 is formed at an edge portion thereof with a prominence and depression portion 342 which is upwardly protruded from the edge portion. The pulsator assembly 350 is connected to an upper portion of the rotating shaft 322 of the gear assembly 320 for oscillatory movement.

The pulsator assembly 350 has a pulsator body 357 having a circular shape, a plurality of agitating blades 362 which are upwardly protruded from an upper surface of the pulsator body 357, first and second auxiliary pulsators 380 and 490 disposed at an upper surface of the pulsator body 357 and being symmetrically arranged opposite to each other about a rotating shaft 322 of the pulsator assembly 350 for moving in the upward and downward directions while the pulsator assembly 350 is being rotated, and first and second elastic members 370 respectively disposed between the first and second auxiliary pulsators 380 and 490 and the pulsator body 357.

Even though a pair of auxiliary pulsators are illustrated in the drawing, the present invention is not limited to that scope. According to another embodiment of the present invention, three or four auxiliary pulsators which are regularly arranged with each other can be provided.

The pulsator body 357 is formed at an upper surface thereof with first and second recesses, and the first and second auxiliary pulsators 380 are hingedly connected to the first and second recesses 351. The first auxiliary pulsator 380 comprises a first plate 359 having a trapezoid shape, a first auxiliary agitating blade 352 which is upwardly protruded from the upper surface of the first plate 359, a first hanger 361 which is downwardly protruded from a lower surface of the first plate 359, and a roller 363 which is rotatably mounted at a lower end portion of the first hanger 361.

The first hanger 359 has a first end portion 356 hingedly connected to the first recess 351, a second end portion 354 disposed opposite to the first end portion and formed the first roller 363 of the first hanger 361 making slide contact with the prominence and depression portion of the spin tub 340, and a middle portion 358 disposed between the first and second end portions 356 and 354 in which the first elastic member 370 is placed.

Figure 7:
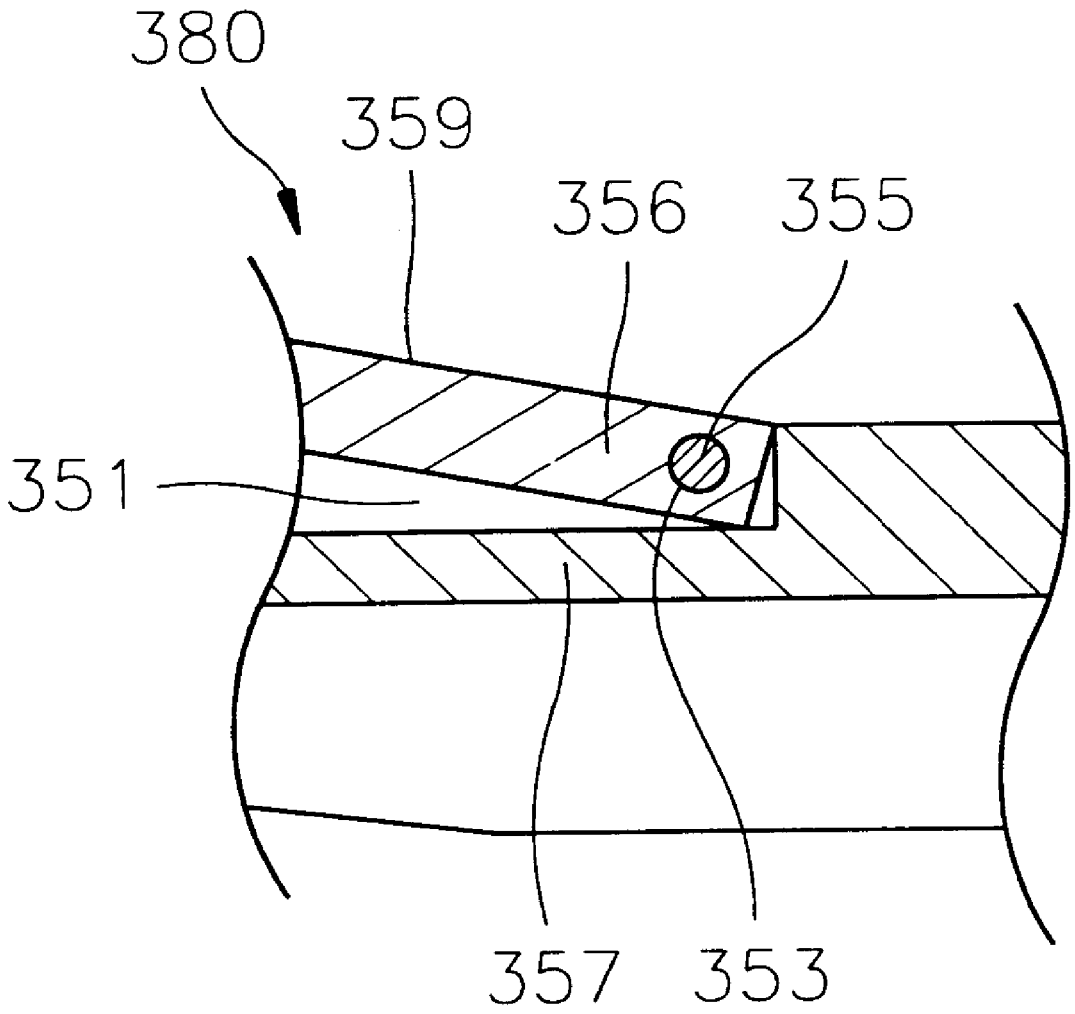
FIG. 7 is a partially enlarged view showing that the plurality of auxiliary pulsators according to the present invention are connected to a body of a main pulsator.

FIG. 7 is a partially enlarged view showing that the first auxiliary pulsators 380 according to the present invention are connected to a pulsator body 357. The first end portion 356 of the first plate 359 is formed with a through hole 353, and the first recess 351 is formed at a position corresponding to the through hole 353 in an inner wall thereof with a pair of receiving grooves (not shown). After the first auxiliary pulsator 380 is received in the first recess 351, a hinge pin 355 is screwed into the pair of receiving grooves through the through hole 353 so that the first auxiliary pulsator 380 is hingedly connected to the pulsator body 357.

Figure 5:
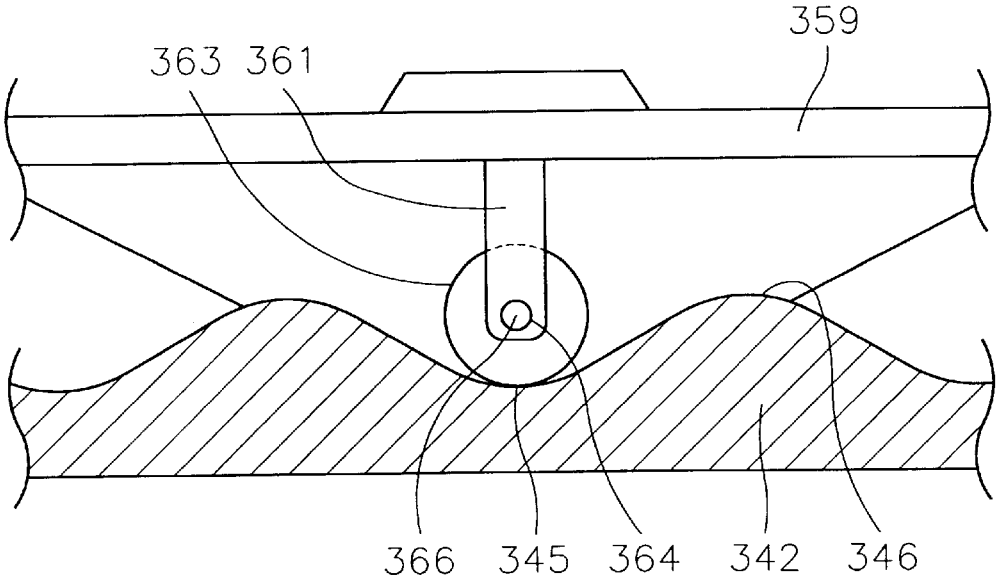
FIG. 5 is a cross-sectional view taken along line B—B in FIG. 2, illustrating a first auxiliary pulsator making contact with a prominence and depression portion of a spin tub.

FIG. 3 is an enlarged cross-sectional view showing a pulsator assembly 350 for the washing machine 300 according to the present invention, and FIG. 5 is a cross-sectional view taken along line B—B in FIG. 2, illustrating a first auxiliary pulsator 380 making contact with a prominence and depression portion 342 of a spin tub 340. The first hanger 361 is downwardly protruded from the lower surface of the second end portion 354 of the first plate 359, and the first roller 363 is rotatably mounted at a lower portion of the first hanger 361.

The first hanger 361 is formed at the lower portion thereof with an elongated slot (not shown) in which the first roller 363 is mounted. The elongated slot is formed at a side surface thereof with a first hole 364, and the first roller 363 is formed at a center portion thereof with a second hole (not shown). The hinge pin 366 penetrates the first and second holes so that the first roller 363 is rotatably mounted at the lower end portion of the first hanger 361.

Moreover, the second end portion 354 of the first auxiliary pulsator 380 extends beyond a circumference of the pulsator body 354. Accordingly, the first roller 363 makes slide contact with an upper surface of the prominence and depression portion formed at the edge portion of the opening 344 of the spin tub 340, thereby moving in the upward and downward directions while the spin tub 340 is being rotated.

The first elastic member 370 is disposed on the middle portion 358 of the first plate 3589 of the first pulsator 380, and the first elastic member 370 includes a compression spring.

An upper locker (383) is formed at a predetermined position of a lower surface of the first auxiliary pulsator 380, and a lower locker(385) is formed at a bottom surface of the first recess 351. Additionally, upper and lower end portions 372 and 374 of the elastic member 370 is fixedly coupled to the upper and lower locker.

The first elastic member 370 makes biasing the first auxiliary pulsator 380 toward the pulsator body 357. Accordingly, when the pulsator body 357 is rotated, the first auxiliary pulsator 380 stably moves in the upward and downward directions along the prominence and depression portion of the spin tub 340.

Figure 4:
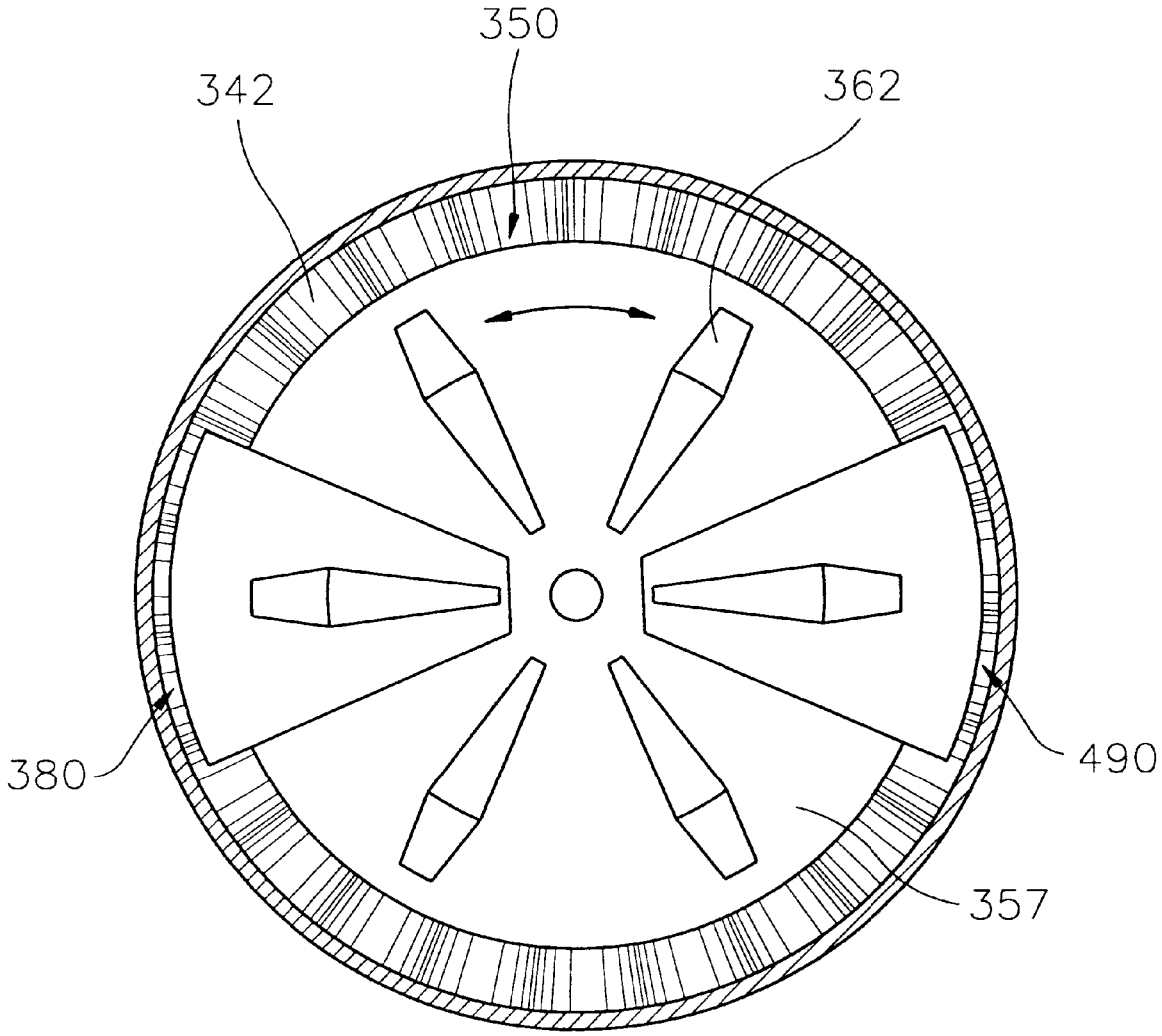
FIG. 4 is a cross-sectional view taken along line A—A in FIG. 2.

FIG. 4 is a cross-sectional view taken along line A—A in FIG. 2, and FIG. 5 is a cross-sectional view taken along line B—B in FIG. 2, illustrating a first auxiliary pulsator 380 making contact with a prominence and depression portion 342 of a spin tub 340. The pulsator body 357 is formed at the upper surface thereof with a plurality of auxiliary agitating blades 362 and with the first and second auxiliary pulsators 380 and 490 arranged among the plurality of auxiliary agitating blades.

The circular-shaped opening of the spin tub (not shown) is formed at an edge portion with a prominence and depression portion 342. The prominence and depression portion 342 is continuously comprised with a convex portion 346 and a concave portion 345.

On the other hand, as illustrated in FIGS. 2 and 3, the second auxiliary pulsator 490 is symmetrically disposed opposite to the first auxiliary pulsator 380.

The second auxiliary pulsator 490 comprises a second plate 459 having a trapezoid shape, a second auxiliary agitating blade 452 which is upwardly protruded from the upper surface of the second plate 459, a second hanger 461 which is downwardly protruded from a lower surface of the second plate 459, and a second roller 463 which is rotatably mounted at a lower end portion of the second hanger 461.

The second hanger 459 has a first end portion 456 hingedly connected to the second recess 451, a second end portion 454 disposed opposite to the first end portion and formed with the second roller 463 of the second hanger 461 making slide contact with the prominence and depression portion 342 of the spin tub 340, and a middle portion 458 disposed between the first and second end portion 456 and 454 in which the second elastic member 470 is placed.

As like the first auxiliary pulsator 380, the second auxiliary pulsator 490 is connected to the pulsator body 357. The first end portion 356 of the second plate 459 is formed with a through hole 453, and the second recess 451 is formed at a position corresponding to the through hole 453 in an inner wall thereof with a pair of receiving grooves (not shown). After the second auxiliary pulsator 490 is received in the second recess 451, a hinge pin 455 is screwed into the pair of receiving grooves through the through hole 453 so that the second auxiliary pulsator 490 is hingedly connected to the pulsator body 357.

Figure 6:
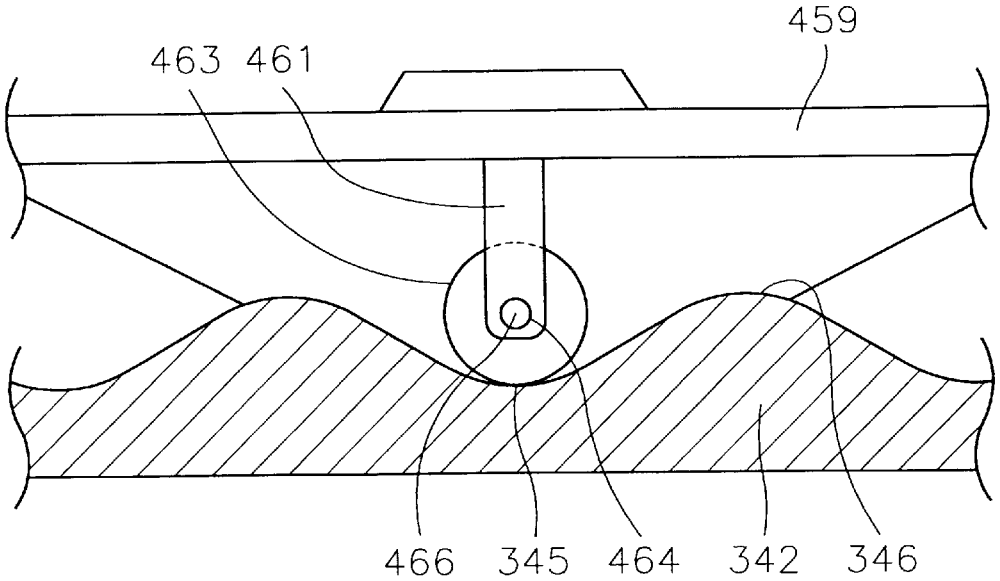
FIG. 6 is a cross-sectional view taken along line C—C in FIG. 2, illustrating a second auxiliary pulsator making contact with the prominence and depression portion of the spin tub.

FIG. 3 is an enlarged cross-sectional view showing a pulsator assembly 350 for the washing machine 300 according to the present invention, and FIG. 6 is a cross-sectional view taken along line B—B in FIG. 2, illustrating a second auxiliary pulsator 490 making contact with a prominence and depression portion 342 of a spin tub 340. The second hanger 461 is downwardly protruded from the lower surface of the second end portion 454 of the second plate 459, and the second roller 463 is rotatably mounted at a lower portion of the second hanger 461.

The second hanger 461 is formed at the lower portion thereof with an elongated slot (not shown) in which the second roller 463 is mounted. The elongated slot is formed at a side surface thereof with a first hole 464, and the second roller 463 is formed at a center portion thereof with a second hole (not shown). The hinge pin 466 penetrates the first and second holes so that the second roller 463 is rotatably mounted at the lower end portion of the second hanger 461.

Moreover, the second end portion 354 of the second auxiliary pulsator 490 extends beyond a circumference of the pulsator body 354. Accordingly, the second roller 463 makes slide contact with an upper surface of the prominence and depression portion 342 formed at the edge portion of the opening 344 of the spin tub 340, thereby moving in the upward and downward directions while the spin tub 340 is being rotated.

The second elastic member 470 is disposed on the middle portion 358 of the second plate 459 of the second pulsator 490, and the second elastic member 470 includes a compression spring.

An upper locker (383) is formed at a predetermined position of a lower surface of the second auxiliary pulsator 490, and a lower locker (385) is formed at a bottom surface of the second recess 451. And, upper and lower end portions 472 and 474 of the second elastic member 470 are fixedly coupled to the upper and lower locker.

The second elastic member 470 makes biasing the second auxiliary pulsator 490 toward the pulsator body 357. Accordingly, when the pulsator body 357 is rotated, the second auxiliary pulsator 490 stably moves in upward and downward directions along the prominence and depression portion 342 of the spin tub 340.

Therefore, when the pulsator body 357 is rotated, the pair of auxiliary pulsators 380 and 490 can maintain a weight balance about the rotation shaft 322 of the pulsator assembly 350.

Hereinafter, the operation of the washing machine having the pulsator assembly according to the present invention will be explained.

As illustrated in FIGS. 2 and 5, when a power is transmitted to the motor assembly 310, the motor assembly 310 begins to drive the gear assembly 320 connected to the motor assembly 310 so that the pulsator body 357 connected to an upper end portion of the rotation shaft 322 of the gear assembly 320 is rotated. At this time, the first roller 363 mounted at a lower portion of the first hanger 361 of the first auxiliary pulsator 380 makes contact with an upper surface of the prominence and depression portion 342 formed at the edge portion of the circular-shaped opening 344 formed at the inner lower portion of the spin tub 340.

When the pulsator body 357 begins to rotate by a driving of the motor assembly 310, the first auxiliary pulsator 380 connected to the main body 357 is also rotated. At this time, since the first roller 363 of the first auxiliary pulsator 380 makes slide contact with the upper surface of the prominence and depression portion 342, the first roller 363 moves from a concave portion 345 to a convex portion 346 along the upper surface of the prominence and depression portion 342.

On the other hand, since the first auxiliary pulsator 380 is downwardly biased by a compression force of the first elastic member 370 which is fixedly mounted at a lower surface of a first plate 359 of the first auxiliary pulsator 380, the first roller 363 is stably moved from the convex portion 346 to the concave portion 345 of the prominence and depression portion 342. Accordingly, while the pulsator body 357 is being rotated, since the first roller 363 repeatedly carries out a process the movement from the concave portion 345 to the convex portion 346 and vice versa, the first auxiliary pulsator 380 continuously moves in the upward and downward directions, thereby generating an upward flow in the spin tub 340.

At the same time, the second auxiliary pulsator 490 connected to the pulsator body 357 in opposite to the first auxiliary pulsator 380 is also moved in the upward and downward directions as the same manner as the first auxiliary pulsator 380, thereby generating an upward flow in the spin tub 340.

Accordingly, while the pulsator body 357 is being rotated, since the first and second rollers 363 and 463 of the first and second auxiliary pulsators 380 and 490 move along the upper surface of the prominence and depression portion 342, consequently the first and second auxiliary pulsators 380 and 490 move in the upward and downward directions. At this time, the upward liquid flow which has been generated by the first and second auxiliary pulsators 380 and 490 collides with a swirl-shaped liquid flow generated by a plurality of agitating blades 362 and first and second auxiliary agitating blades 352 and 452, thereby creating a turbulent liquid flow in the spin tub 340. As a result, the articles to be washed are prevented from tangling with each other, and the washing effect is improved.

As above described, since the pulsator assembly of the washing machine agitates the upward liquid flow by the pair of auxiliary pulsators while the washing cycle is being executed, the turbulent liquid flow is generated in the spin tub, and thereby preventing the articles from tangling with each other. Furthermore, the turbulent liquid flow collides with the articles, thereby improving the washing effect.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing machine comprising:

an outer tub;

a spin tub rotatably accommodated within the outer tub;

a main pulsator rotatably disposed at an inner lower portion of the spin tub;

a plurality of auxiliary pulsators disposed at an upper surface of the main pulsator, the plurality of auxiliary pulsators being symmetrically arranged opposite to each other about a rotating shaft of the main pulsator, the plurality of auxiliary pulsators being moved in upward and downward directions while the main pulsator is being rotated, thereby generating a turbulent liquid flow in the spin tub; and a plurality of elastic members respectively disposed between the plurality of auxiliary pulsators and the main pulsator for elastically biasing the plurality of auxiliary pulsators toward the main pulsator.

2. The washing machine as claimed in claim 1, wherein the washing machine includes two auxiliary pulsators which are symmetrically disposed with respect to each other.

3. The washing machine as claimed in claim 1, wherein the spin tub is formed at the inner lower portion thereof with a circular-shaped opening in which the main pulsator is mounted, the circular-shaped opening being formed at an edge portion thereof with a prominence and depression portion which is upwardly formed from the edge portion, the plurality of auxiliary pulsators making slide contact with an upper surface of the prominence and depression portion so that the plurality of auxiliary pulsators are upwardly and downwardly moved while the main pulsator is being rotated.

4. The washing machine as claimed in claim 3, wherein the main pulsator has a pulsator body and a plurality of recesses formed at an upper surface of the pulsator body, the plurality of recesses having a shape corresponding to a shape of the plurality of auxiliary pulsators, each auxiliary pulsator being respectively received in each of the recesses.

5. The washing machine as claimed in claim 4, wherein each auxiliary pulsator respectively has a plate received in each of the recesses, auxiliary agitating blades upwardly protruded from an upper surface of the plate, a hanger downwardly protruded from a lower surface of the plate, and a roller rotatably mounted at a lower end portion of the hanger.

6. The washing machine as claimed in claim 5, wherein the recesses and the plate have a trapezoid shape.

7. The washing machine as claimed in claim 5, wherein each of the plates has a first end portion formed with a through hole, each of the recesses is formed at an inner wall thereof with a pair of receiving holes, and a hinge pin is screwed into the pair of receiving holes through the through hole so that each of the plurality of auxiliary pulsators is hingedly connected to the main pulsator.

8. The washing machine as claimed in claim 7, wherein each of the hangers is provided to a lower surface of a second end portion disposed opposite to the first end portion of the plate, and the second end portion extends beyond a circumference of the main pulsator so that the roller of the hanger makes slide contact with the upper surface of the prominence and depression portion.

9. The washing machine as claimed in claim 7, wherein each of the hangers is formed at a lower portion thereof with an elongated slot, and the roller is rotatably mounted within the elongated slot.

10. The washing machine as claimed in claim 9, wherein each roller is respectively and rotatably fixed within the elongated slot by a hinge pin.

11. The washing machine as claimed in claim 10, wherein each of the plurality of elastic members includes a compression spring.

12. The washing machine as claimed in claim 5, wherein an upper locker is respectively formed at a predetermined position of the lower portion of the plate of each auxiliary pulsator, and a lower locker is respectably formed at a predetermined position of a bottom surface of each recesses, and an upper end portion and a lower portion of the plurality of elastic members are fixedly coupled to the upper and lower lockers, respectively.

* * * * *